United States Patent [19]

McDermott

[11] 4,146,858

[45] Mar. 27, 1979

[54] COIL ASSEMBLY FOR AN ELECTROMAGNETIC HIGH ENERGY IMPACT APPARATUS

[75] Inventor: Arthur W. McDermott, Maple Valley, Wash.

[73] Assignee: The Boeing Company, Seattle, Wash.

[21] Appl. No.: 872,418

[22] Filed: Jan. 26, 1978

[51] Int. Cl.[2] ..... H01F 27/30

[52] U.S. Cl. ..... 336/90; 29/605; 335/299; 336/96; 336/205; 336/206; 336/223

[58] Field of Search ..... 335/299; 336/206, 205, 336/90, 232, 223, 208, 209, 96; 29/605

[56] References Cited

U.S. PATENT DOCUMENTS 3,231,842 1/1966 Browar et al. ..... 335/299 X

*Primary Examiner*—Thomas J. Kozma

*Attorney, Agent, or Firm*—Conrad O. Gardner; B. A. Donahue

[57] ABSTRACT

An EMR coil assembly having a split housing including a coil-retaining body member and ring member attached thereto, the EMR coil assembly including a coil having a plurality of polyimide face sheets disposed between a polyester face sheet forming the outer wear surface of the coil and a major surface of the coil.

2 Claims, 16 Drawing Figures

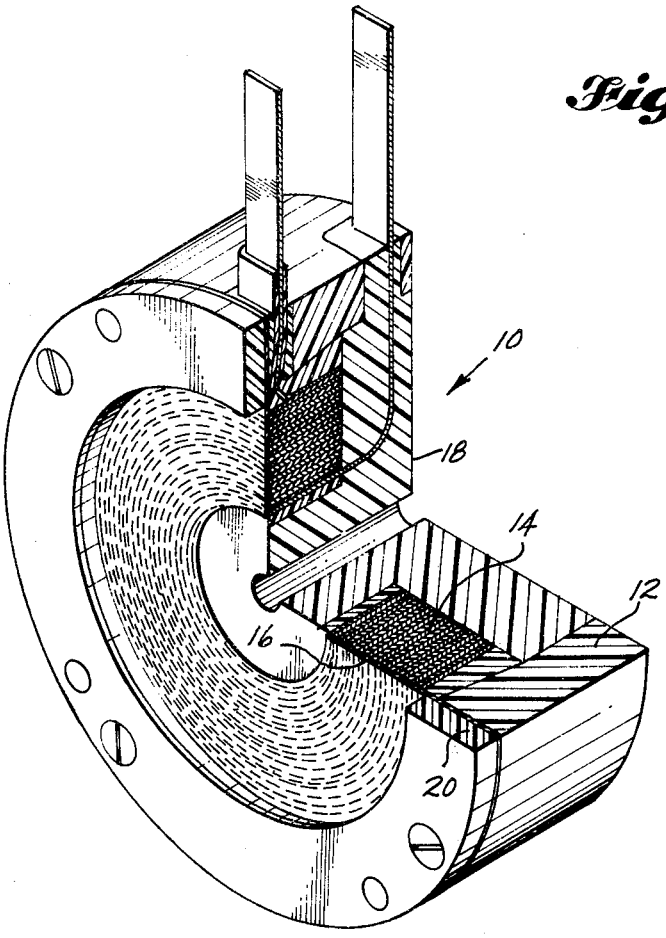
Fig. 2
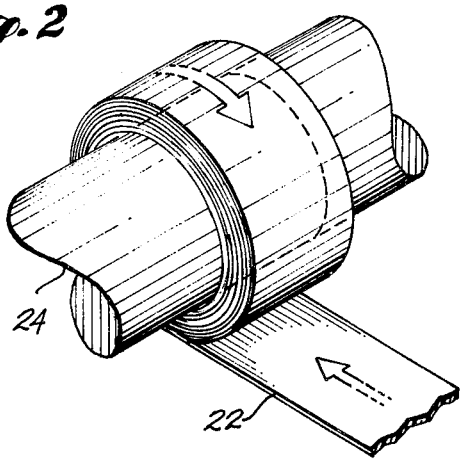
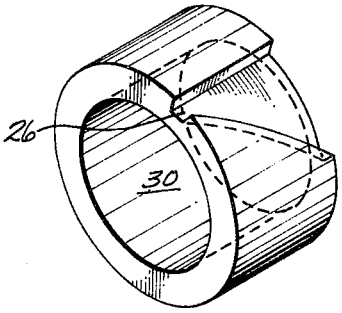
Fig. 3
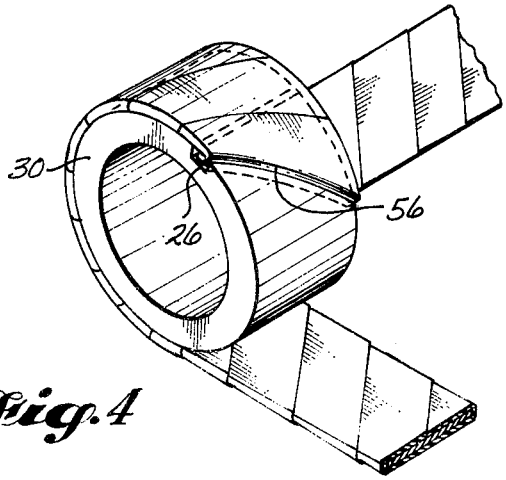
Fig. 4

COIL ASSEMBLY FOR AN ELECTROMAGNETIC HIGH ENERGY IMPACT APPARATUS

This invention relates to coil assemblies for EMR (electromagnetic riveting) guns and the method of making such coil assemblies, such as shown in U.S. Pat. No. 3,737,990 to Schut, also assigned to The Boeing Company.

Prior art EMR guns have included a coil assembly and a method of making thereof, such as shown and described in the aforereferenced U.S. Pat. No. 3,737,990. Such coil assembly, herein incorporated by reference, can be seen to have included a pair of polyimide face sheets placed on both major faces of the coil with outside wrapping build-up disposed therearound, which assembly was clamped and subsequently fused inside the outer coil body in a single operation to provide subsequent to installation in an outer retaining ring the coil assembly for the EMR gun.

It is an object of this invention to provide an EMR coil assembly having a split housing including a coil-retaining body member and a ring member, which ring member is installed by attachment to the coil-retaining body member subsequent to installation of a polyester face sheet forming the outer wear surface of the foil and prior to bonding of the sheet.

It is another object of this invention to provide in the method of making a coil assembly for an EMR gun for the etching of the coil prior to banding the outer circumference of the coil and bonding.

Other features and objects of the invention will be apparent from the following detailed description when read with the accompanying drawings.

In the drawings:

FIG. 1 shows the completed coil assembly made in accordance with the present method with quarter section cut-away for increased clarity in revealing details of the inner structure thereof;

FIG. 2 shows a step in the process of making the center core, viz., winding of plural layer polyimide plastic insulation film;

FIG. 3 shows the finished machined center core;

FIG. 4 shows the inner terminal of the coil formed in the machined slot of the center core;

Figure 5:
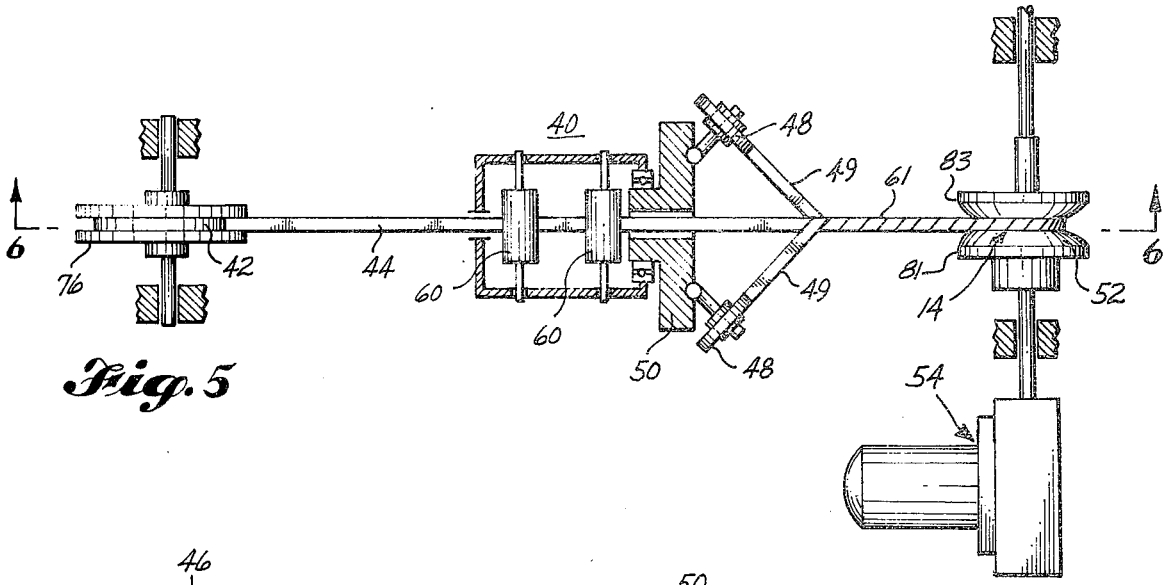
FIG. 5 shows a top plan view of the winding apparatus for winding the conductor strip with polyimide tape and around the center core.

Turning now to FIG. 1 for a general overview of several important features provided in the present coil assembly 10, it will be noted that coil assembly 10 includes a split housing comprising coil-retaining body member 12 made of a reinforced dielectric material serving for the purpose of containing coil 14 in such a manner (hereinafter described in more detail) that the wear surface provided by the polyester face sheet 16 is geometrically parallel with the bottom surface 18 of coil assembly 10 so that when coil assembly 10 is installed in EMR (electromagnetic riveting) gun having a ram assembly, e.g., ram assembly 300 shown in FIGS. 3 and 4 of U.S. patent application Ser. No. 837,487, filed Sept. 28, 1977, also assigned to The Boeing Company, point contact between conductive driving plate 321 and the outer wear surface of the coil is reduced.

Figure 12:
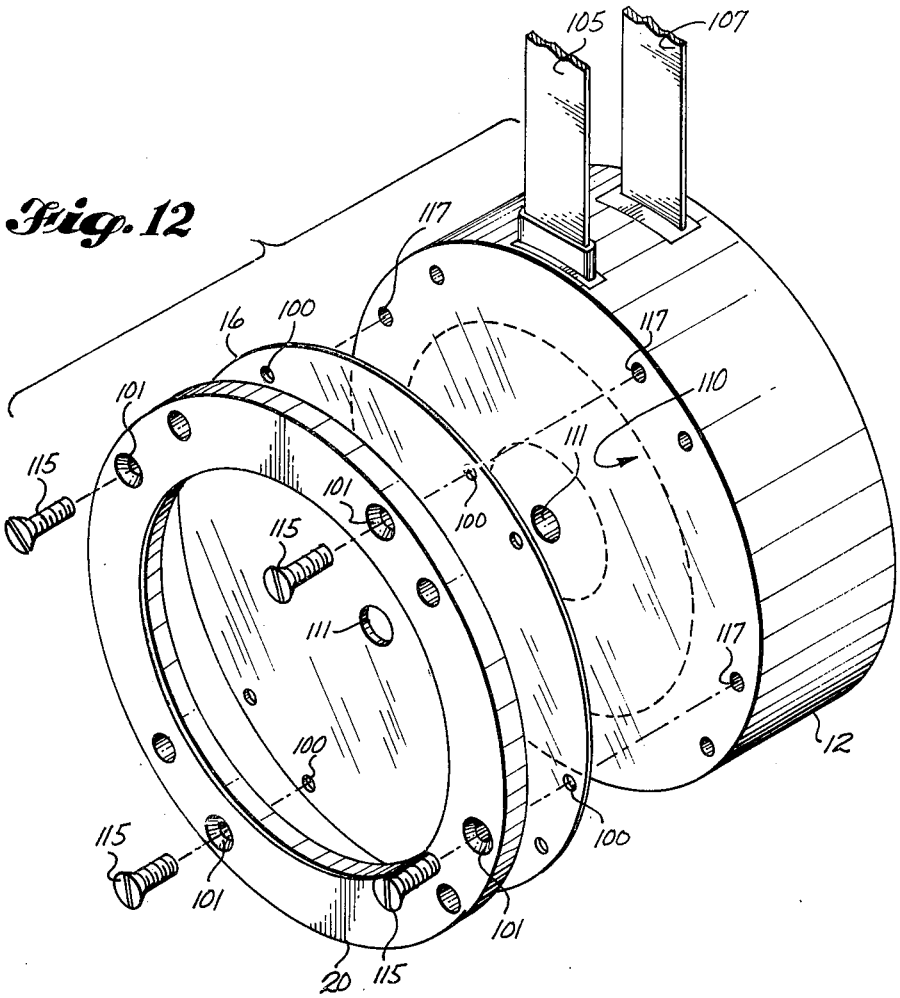
FIG. 12 is an exploded view of the coil assembly showing the coil, polyester face sheet and ring member of the split housing prior to bonding of the polyester face sheet to the coil face.

Ring member 20 enables strapping down of polyester face sheet 16 as shown in FIG. 12 prior to bonding of polyester face sheet in a manner hereinafter discussed providing holding power for the wear surface during bonding. Ring member 20, since fastened to coil-retaining body member 12 as shown in FIG. 1, may be removed to gain access to coil 14 and thereby facilitate repair of coil 14 when defects are noted therein through face sheet 16, which is made of about a 7-mil thickness polyester which is transparent and available under the trade name Mylar, of the DuPont Company of Wilmington, Delaware.

The coil assembly 10 of FIG. 1 and method of making thereof will be described in the following portion of the specification under subtitles in accordance with the sequence of steps taken in the manufacture thereof.

COIL CENTER CORE 30 FABRICATION PROCEDURE

The step-by-step fabricating procedure for making core 30 included: tight winding a polyimide insulation film 22 on mandrel 24. This material was commercially available from DuPont Company of Wilmington, Delaware, under the trade name "Kapton," and Type F was used, which was DuPont Type 200F919. Winding was started on mandrel 24 (with two layers of H-type first placed on the mandrel to provide release from the mandrel 24 after fusing) until a build-up of approximately 1.5 inches O.D. thickness was reached to allow for machining to desired dimension after fusing. Winding about mandrel 24 was finished by a winding of Kapton H-type pressure-sensitive tape to prevent loosening of the winding 22 of Kapton F film. The finished winding 22 forming coil center core 30 was clamped with steel hose clamps and coated with Frekote, a parting agent of Fre Kote Manufacturing Company of Boca Raton, Florida. Finished coil center core 30, comprising the aforementioned completed winding 22 on mandrel 24, is then disposed in an oven preheated to 550 degrees F. ± 25 degrees F. for 30 minutes. Mandrel 24 and winding 22 are then removed for cooling in still air at ambient room temperature. Coil center core 30 is then machined to include slot 26 as shown in FIG. 3.

EMR COIL 14 FABRICATION

Figure 6:
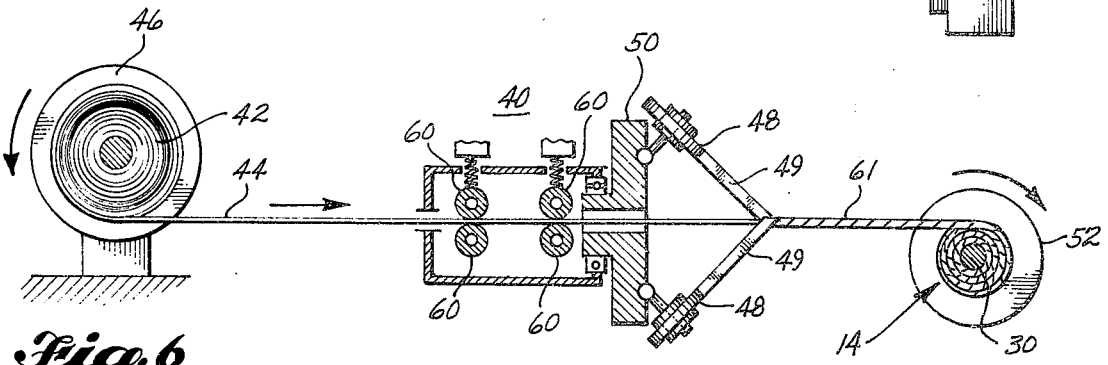
FIG. 6 is a sectional view of the winding apparatus of FIG. 5 taken along the line 6—6 of FIG. 5.

Turning now to FIGS. 5 and 6, showing winding apparatus 40, it will be noted that a coil 42 of copper strip 44 having a rectangular cross section is disposed on payoff reel 46 of winding machine 40. Also, it should be noted that rolls 48 of Kapton type F film 49 defined earlier as comprising a polyimide film are disposed on tape head 50 of winding apparatus 40 for serving copper strip 44 with one layer of film 49 with 40 to 50 percent overlap, taking care at all times to avoid the occurrence of triple layers of coil insulation.

Figure 7:
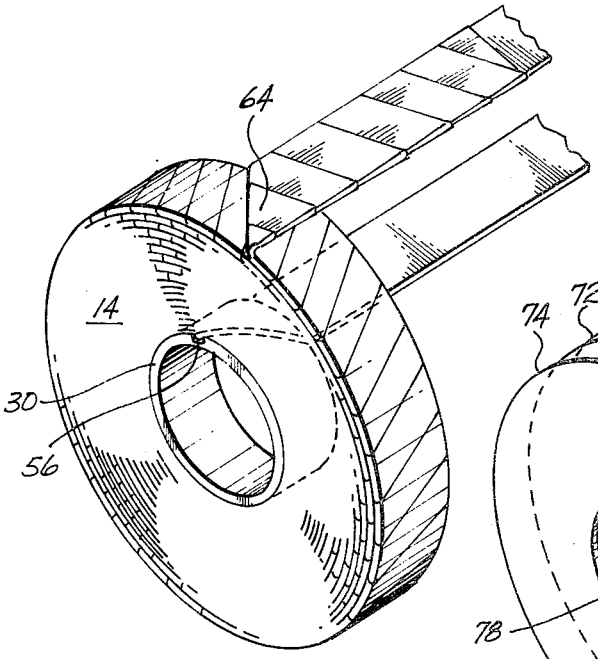
FIG. 7 shows the outer terminal fold.

Coil center coil 30 (see FIG. 6) is first positioned on winding reel 52 which is driven by electric motor 54. Subsequently, enough of copper strip 44 wound with polyimide film 49 is served through tape head 50 to allow the forming of inner terminal fold 56, shown in FIG. 4 (and also in FIG. 7) in slot 26. Inner terminal fold 56 is wrapped with two extra layers of Kapton H pressure-sensitive tape before clamping coil center core 30 to commence winding of winding reel 52. The first turn of electrically insulatively wrapped copper strip 44 is wound to provide EMR coil 14 without application of tension on wrapped copper strip 44 to avoid pulling on the aforementioned inner terminal fold 56 and winding tension is applied after first overlap of inner terminal fold 56 has occurred. Tight winding tension is maintained by adjusting taping head pressure rollers 60 to sufficient pressure for driving taping head 50 without stretching copper strip 44. A turn counter (not shown) is set at 1 and a total of 27 turns of electrically insulatively wrapped conductor 61 are wound to form coil 14. The 27th turn is taken back (with the 26th turn clamped to prevent coil 14 from unwinding and loosening up) to then provide outer terminal fold 64 (see FIGS. 7 and 8), whereupon the 26th turn is unclamped while holding electrically insulatively wrapped conductor 61 under tension and the winding of the last (27th turn) is then completed. Four to six turns of polyimide tape (Kapton) are then wrapped on the outside of the 27th turn.

Figure 8:
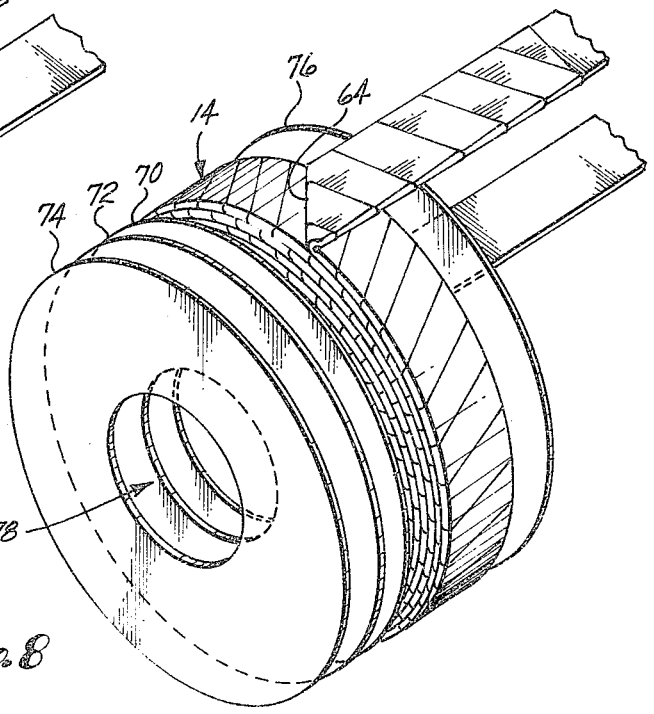
FIG. 8 shows positioning of a fluorocarbon resin sheet on the top (left) surface of the coil followed by two further polyimide sheets thereon and further positioning of a single polyimide sheet on the bottom (right) nonworking surface side of the coil prior to insertion thereof between plates of a press and subsequent disposal thereof in a vacuum furnace.

A 0.020-inch thick fluorocarbon resin sheet 70, sold under the tradename "Teflon" of the DuPont Company of Wilmington, Delaware, is disposed as shown in FIG. 8 on the front face of EMR coil 14 followed by first 72 and second 74 polyimide sheets (Kapton F), while a further polyimide sheet (Kapton F) 76 is disposed on the rear face of EMR coil 14. The required center hole 78 (as seen in FIG. 8) is cut in sheets 70, 72, 74 and 76 with a one-inch diameter punch tool. Coil 14 sandwiched between sheets 70, 72, 74 and 76 as shown in FIG. 8 is then disposed between plates 81 and 83 of winding reel 52, and with plates 81 and 83 removed from winding reel 52 (with aforementioned assembly of FIG. 8 disposed therebetween), plates 81 and 83 are squeezed together with a force of about 10,000 pounds and five type-300 stainless steel bolts are installed therebetween with 40-inch/pounds minimum fastening torque providing clamping, whereupon pressure is released and the assembly, including outer plates 81 and 83, is placed in a plastic bag, vacuum drawn, and sealed prior to insertion thereof in a vacuum furnace. Upon inserting the assembly, including outer plates 81 and 83 in a vacuum furnace, evacuation is done to a minimum of about 26 to 29 inches Hg and then heat is applied to 550 degrees F. ± 25 degrees F. for about 1 hour and subsequently raised to 600 degrees F. ± 25 degrees F. for 30 minutes, whereupon cooling is done to 150 degrees F. in an inert atmosphere (argon or helium purge preferred) and the assembly between plates 81 and 83 removed, whereupon the outer diameter bank of turns of Kapton discussed earlier on coil 14 and the inside diameter of core 30 are scored with a sharp tool and the entire assembly, including coil 14 with sheets 70, 72, 74, and 76 is then etched. After etching the entire assembly is reinserted in winding reel 52 for banding and the outside diameter is wound with ¾-inch-wide perma-fill fiber glass tape, e.g., General Electric Company type 76830, the fiber glass tape being impregnated with varnish and wound at 200 pounds minimum tension to provide an overall 4-inch outside diameter and thereafter secured by a banding with a minimum of about 10 turns of a heat shrinkable polyester tape (e.g., General Electric Company type 76851) to provide a finished overall diameter of about 4 3/16 inches. Coil assembly 14, including outer sheets 70, 72, 74 and 76, is subsequently placed between two aluminum plates faced with Teflon in a press loaded to about 10,000 pounds, the aforementioned perma fill fiber glass tape cured, then removed and machine tapered with outside wrapping removed to the extent shown from dotted line 80 in FIG. 9.

POTTING PROCESS FOR COIL ASSEMBLY 14 OF FIG. 9

Figure 9:
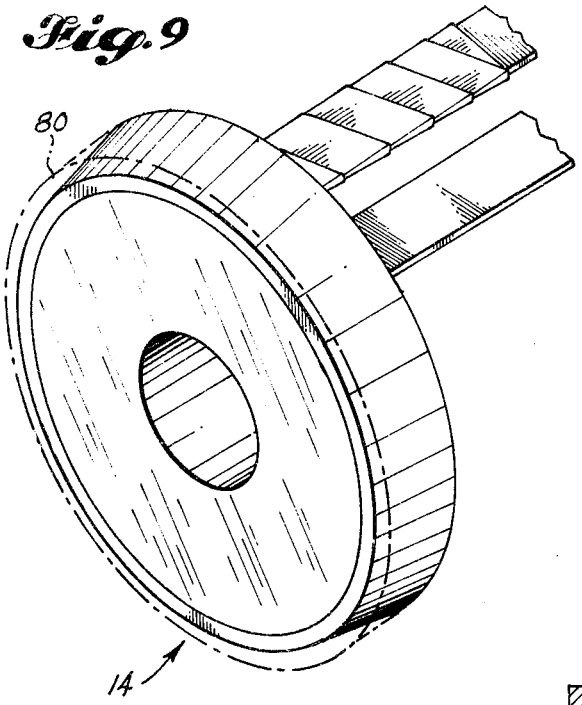
FIG. 9 shows a coil with outside wrapping build-up machined away from the dotted line to provide the taper shown.
Figure 10:
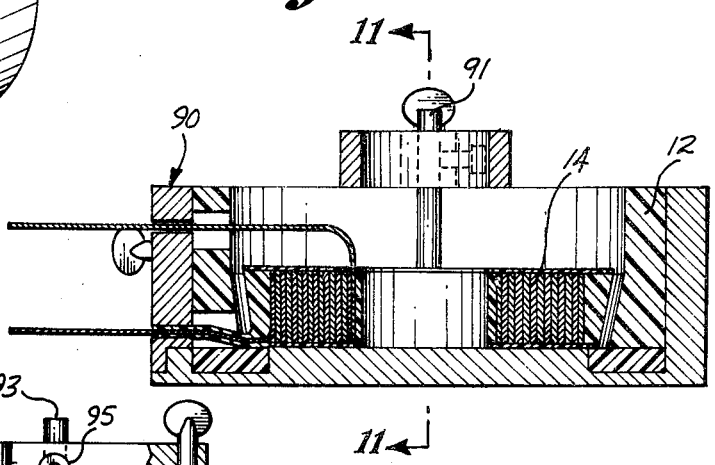
FIG. 10 shows the coil assembly in the mold in preparation for potting.
Figure 11:
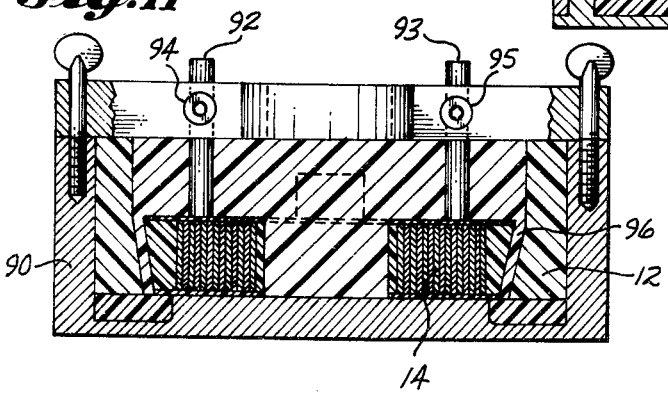
FIG. 11 is a sectional view taken along the lines 11—11 of FIG. 10 showing the coil assembly potted.

Coil assembly 14 of FIG. 9 is positioned face down in mold 90 as shown in FIG. 10 centering coil assembly 14 on locating plug 91 and secured in position by means of two ⅜ inch diameter fiber glass rods 92 and 93, pushing down on coil assembly 14, as shown in FIG. 11, which fiber glass rods 92 and 93 are fastened in place by corresponding set screws 94 and 95 and with fiber glass rods 92 and 93 becoming an integral part of coil assembly 14 during the potting operation. In the potting operation a mixture 96 of chopped glass mixed into a potting resin with hardener is poured into mold 90 between coil assembly 14 and split housing coil-retaining body member 12 and first room-temperature cured prior to insertion of mold 90 into an oven for oven cure.

BONDING OF POLYESTER FACE SHEET 16 FORMING THE OUTER WEAR SURFACE TO COIL ASSEMBLY 14

Turning now to FIG. 12, it can be seen that ring member 20 is removed from the face of coil-retaining body member 12 and polyester face sheet 16, having a 7-mil ± 1 mil thickness, is cut and four holes are punched therein to match the four equiangularly disposed holes 101 disposed in ring member 20. The aforementioned range of thickness specified for polyester face sheet 16 results in desired EMR coil inductance of 32 to 37 microhenries (open circuit inductance between EMR coil terminals 106 and 107) without the aforementioned EMR gun conductive driving plate 321 (shown in the aforementioned referenced application, Ser. No. 837,487) in position against polyester face sheet 16 subsequent to the bonding thereof, and a desired EMR coil inductance of 14 to 19 microhenries with driving plate 321 in position against polyester face sheet 1 subsequent to bonding thereof. The surface of polyester face sheet 16 which is to be bonded, i.e., that facing coil housing surface 110 is abraded with an abrasive pad as is also the peripheral portion of the other surface of polyester face sheet 16 underlying ring member 20 where ring member 20 will be bonded over polyester face sheet 16. A ¼ inch diameter hole 111 is then drilled through the center of polyester face sheet 16 and surface 110.

Figure 13:
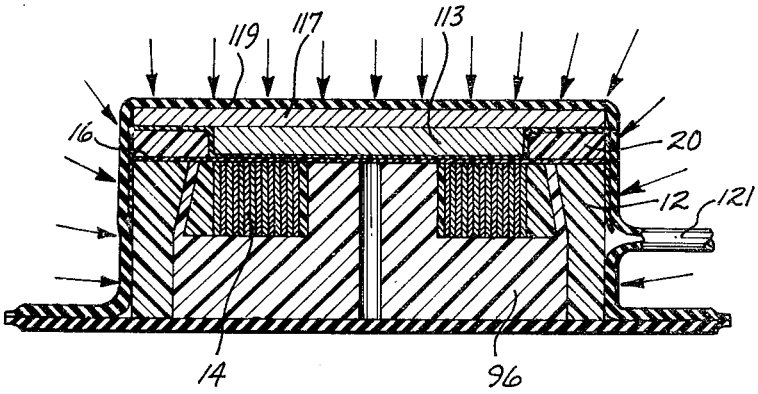
FIG. 13 shows bonding of the polyester face sheet to the etched polyimide coil face by vacuum bagging while heating.

10 to 15-mil layer of curing adhesive, e.g., BMS 5-31 type 51 adhesive, a polysulfide obtainable from Coast Pro-Seal of Compton, California, is applied to etched coil face surface 110 and to the surface of ring member 20 facing polyester face sheet 16. The abraded surface of polyester face sheet 16 is then disposed against curing adhesive covered coil face surface 110 as shown in FIG. 13, ring member 20 is positioned on top of polyester face sheet 16 and screws 115 (shown in FIG. 12) are tightened down into corresponding cupped holes 117 in coil-retaining body member 12 applying about 20 in./lb. torque. A ¼-inch thick aluminum pressure disk 113 (as seen in FIG. 13) is then inserted as shown within ring member 20 in a manner to insure even transfer of vacuum pressure to polyester face sheet 16. The assembly is then covered with a bleeder cloth 117 and flexible film bag to assure vacuum tightness and a vacuum is drawn at outlet 121 of 22 to 30 inches Hg so that this vacuum pressure is then applied to the surface of aluminum pressure disk 113. Vacuum is maintained for a 24-hour period to fully cure the aforementioned adhesive at a room temperature of 74 degrees F.

Figure 14:
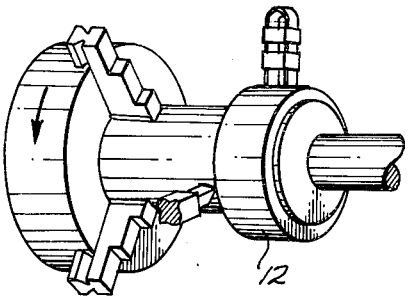
FIG. 14 shows machining flat of the face of the coil-retaining body member of the split housing for reference index.
Figure 15:
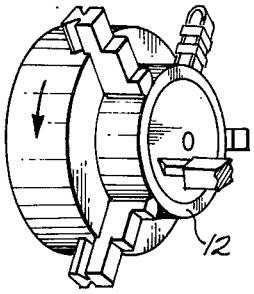
FIG. 15 shows machining of the bottom major surface of the coil flat and parallel to the top wear surface of the coil formed by the polyester face sheet.
Figure 16:
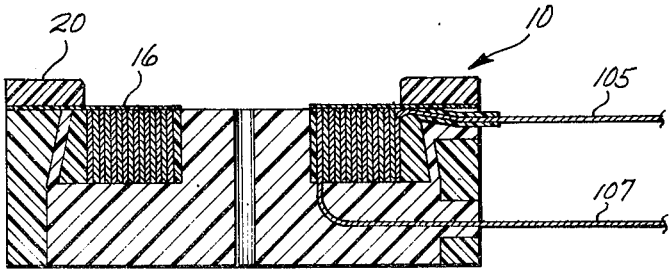
FIG. 16 is a sectional view taken through the finished coil showing the parallel relationship between top and bottom surfaces.

Subsequently, as shown in FIGS. 14 and 15, respectively, the face of coil-retaining body member 12 is machined flat and the bottom major surface of the finished EMR coil is machined flat and parallel to the top wear surface of the coil formed by the polyester face sheet.

I claim:

1. An electromagnetic riveting coil assembly having a split housing including a coil-retaining body member and ring member attached thereto, said electromagnetic riveting coil assembly including a coil disposed within said coil-retaining body member, said coil having a plurality of polyimide face sheets disposed between a polyester face sheet forming the outer wear surface of the coil and a major surface of the coil, and said polyimide face sheet extending between said coil-retaining body member and said ring member and coextensive with the outer periphery of said ring member.

2. The invention according to claim 1 wherein said polyester face sheet has a thickness of 7 mil ± 1 mil.

* * * * *